US006039483A

United States Patent [19]

Szekely

[11] Patent Number: 6,039,483

[45] Date of Patent: Mar. 21, 2000

[54] ROTARY DISPENSER

[75] Inventor: Alex S. Szekely, Jackson, N.J.

[73] Assignee: The Plastek Group, Erie, Pa.

[21] Appl. No.: 09/289,418

[22] Filed: Apr. 9, 1999

Related U.S. Application Data

[63] Continuation-in-part of application No. 08/744,091, Nov. 5, 1996, abandoned.

[51] Int. Cl.[7] ..... A45D 40/04

[52] U.S. Cl. ..... 401/50; 401/68; 401/175; 401/176; 401/194; 401/266; 222/390

[58] Field of Search ..... 401/50, 266, 194, 401/68, 175, 176; 222/390

[56] References Cited

U.S. PATENT DOCUMENTS 5,025,960 6/1991 Seager ..... 222/390
5,186,561 2/1993 Ackermann et al. ..... 401/78
5,725,133 3/1998 Iaia ..... 222/390

*Primary Examiner*—Henry J. Recla
*Assistant Examiner*—Peter deVore
*Attorney, Agent, or Firm*—Bachman & LaPointe, PC

[57] ABSTRACT

A dispenser assembly includes an inner housing having an upper end, a lower end, and a wall defining a product space for containing a product to be dispensed; an outer housing having an upper end, a lower end, and a wall defining an inner space, the inner housing being rotatably mounted within the outer housing so that the inner housing can be rotated relative to the outer housing; structure within the housing for advancing product toward the upper end responsive to rotation of the inner housing relative to the outer housing; and a transfer member fixed relative to the outer housing and rotatably associated with the upper end of the inner housing, the transfer member having an applicator surface for applying product to a desired area, and at least one slot in the applicator surface for allowing transfer of product from the product space through the transfer member to the applicator surface.

10 Claims, 4 Drawing Sheets

ROTARY DISPENSER

CROSS REFERENCE TO RELATED APPLICATION

This application is a Continuation-In-Part of patent application Ser. No. 08/744,091, filed Nov. 5, 1996, now abandoned.

FIELD OF THE INVENTION

The present invention relates to dispensers and to dispenser packages which discharge product in the form of a creme or gel, especially those having a viscosity ranging from 50,000 to 200,000 centipoise where the overall package is used to apply product to surfaces.

BACKGROUND OF THE INVENTION

Many cremes and gels are dispensed under pressure and as a result of the pressure tend to breakdown into their original constituent parts or tend to bleed from the dispenser as a result of residual internal pressure after application.

Obviously both of the above occurrences are undesirable and will affect the efficacy of the product or create an untidy condition about the package.

BRIEF SUMMARY OF THE INVENTION

Accordingly, the present invention presents a dispenser which does not develop the above noted undesirable conditions. The dispenser is particularly useful as a dispenser for deodorants and the like.

It is a feature of the present invention to provide a product transfer member which moves and dispenses product from a package at a rate which is equal substantially to the rate at which product is supplied thus insuring that product is not subjected to increased pressure.

That is, product advanced to the transfer member never exceeds the rate at which product is delivered by the transfer member.

A further feature of the invention is the provision of a rotary transfer member and a product elevator where the transfer member is fixed to a lead screw and the lead screw is in threaded engagement with the elevator so that rotation of the transfer member is operable to move the product toward the transfer member.

A further feature of the invention is that the lead of the lead screw is selected so that upon rotation of the transfer member adequate product is advanced toward the transfer member.

A further feature of the invention is the provision of a novel dispenser assembly having a minimum number of piece parts.

A dispenser is provided in accordance with the present invention which comprises: an inner housing having an upper end, a lower end, and a wall defining a product space for containing a product to be dispensed; an outer housing having an upper end, a lower end, and a wall defining an inner space, said inner housing being rotatably mounted within said outer housing so that said inner housing can be rotated relative to said outer housing; means within said housing for advancing product toward said upper end responsive to rotation of said inner housing relative to said outer housing; and a transfer member fixed relative to said outer housing and rotatably associated with said upper end of said inner housing, said transfer member having an applicator surface for applying product to a desired area, and at least one slot in said applicator surface for allowing transfer of product from said product space through said transfer member to said applicator surface.

BRIEF DESCRIPTION OF THE DRAWINGS

Other features and advantages of the present invention will become more apparent from an examination of the following detailed description when read in conjunction with the appended drawings, in which.

DETAILED DESCRIPTION OF THE INVENTION

Figure 3:
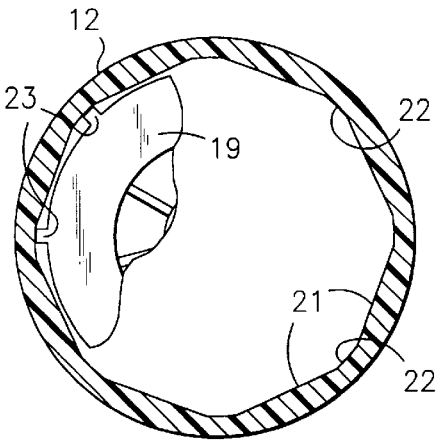
FIG. 3 is a cross-sectional view of FIG. 1 in the plane of the line 3—3.

The reference numeral 11 designates the dispenser package generally having a housing means 12 for containing product P (FIGS. 1 and 8) supporting a product transfer means 13 operable to transfer or lift product from the interior of the housing means to an applicator surface 14 as the transfer means is rotated manually in the direction of the arrow 16 relative to the housing means.

Figure 2:
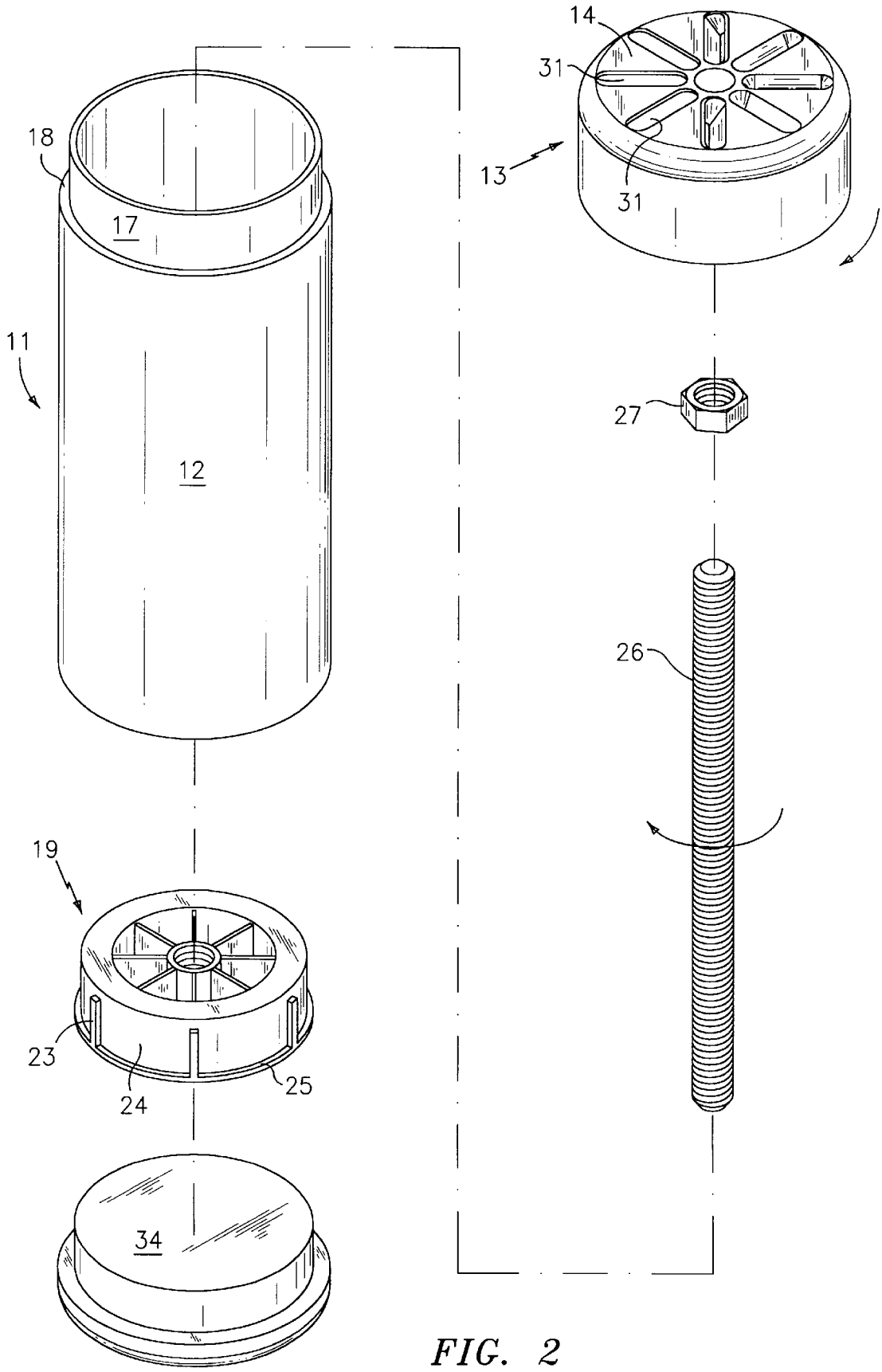
FIG. 2 is an exploded view of typical piece parts of an operative dispenser unit.

The housing means 12 is tubular, as is most apparent in FIG. 2, and receives the transfer means 13 in telescopic fashion as the housing means extension 17 (FIG. 2) is received within the transfer means as it bottoms on the shoulder 18.

Figure 4:
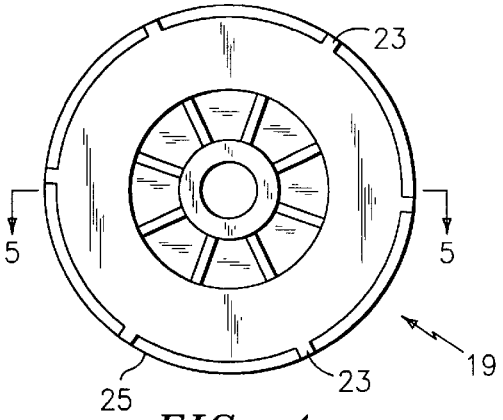
FIG. 4 is a plan view of a product elevator.
Figure 5:
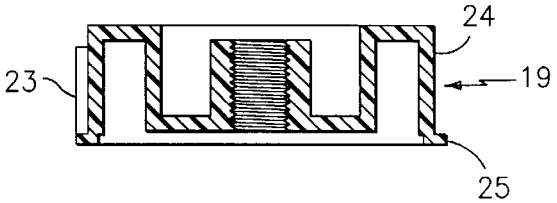
FIG. 5 is a vertical section of the showing of FIG. 4 in the plane of the line 5—5.
Figure 1:
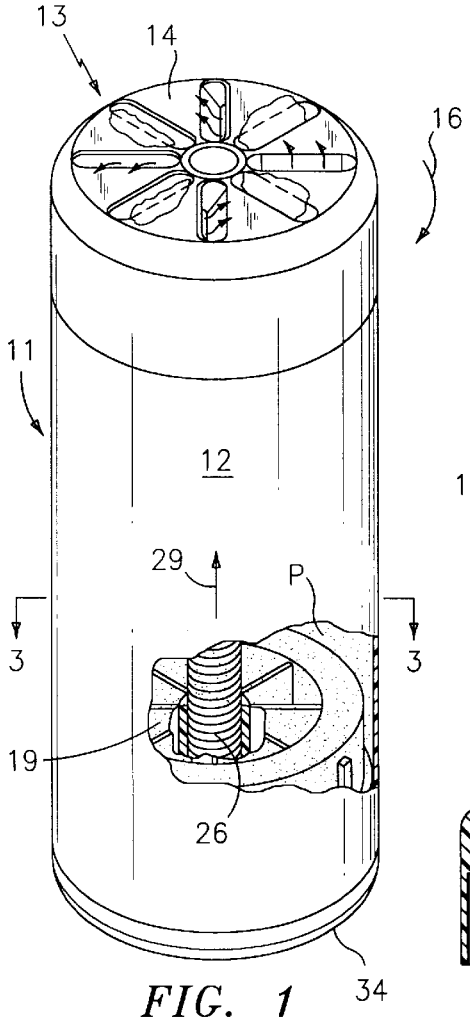
FIG. 1 is a perspective view of a dispenser package according to the invention.
Figure 6:
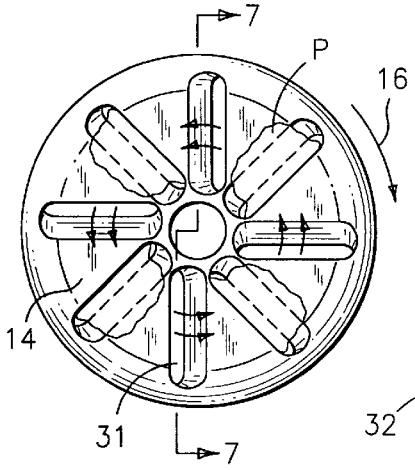
FIG. 6 is a top plan view of the transfer means supported rotatably by the housing means.

The housing means 12 contains a product elevator 19 shown in FIGS. 2, 4 and 5 and shown partially in broken away and fragmentary portions of FIGS. 1 and 3. The interior of the housing means defines a regular polygon having intersecting flats 21 defining keyways 22 operative to engage keys or ribs 23 formed on the sidewall 24 of the elevator 19. In addition, the sidewall of the elevator may be formed with a circumferential rim 25 making a snug fit with the interior of the housing means.

The key-keyway arrangement and the snug rim fit are provided to block rotation of the elevator within the housing means while the elevator is free to advance axially (vertically) as will be explained in greater detail hereinafter.

It is understood that the structure of the means for blocking rotation of the elevator can utilize a key-keyway arrangement solely, or a snug friction fit between the elevator and the interior of the housing means or a combination of a friction fit and a key-keyway (as in the disclosed embodiment of the invention) as design considerations and product viscosity dictate.

The transfer means 13 is connected fixedly to a lead screw 26 by threaded engagement therewith and locked to the lead screw by lock unit 27, obviously, other means for fixing the transfer means to the lead screw may be devised; the only limitation being that the lead screw rotate in unison with rotation of the transfer means as shown by the arrows of FIG. 2.

The opposite end of the lead screw 26 is in threaded engagement with the elevator 19 as shown in the break away of FIG. 1.

Thus, when the transfer means 13 is rotated relative to the housing means 12, the lead screw rotates. As stated previously the elevator is blocked against rotation so that as the lead screw rotates the elevator moves axially in the direction of the arrow 29 (FIG. 1) advancing product P toward the transfer means.

Obviously the hand (right or left) of the lead screw must be selected to insure that the elevator moves upwardly toward the transfer means in response to rotation of the transfer means 13.

The transfer means includes application surface 14 interrupted by a plurality of radially disposed slots 31 providing passageways leading from the interior of the housing means to the applicator surface for effecting product transfer from the interior of the housing means to the applicator surface.

The means for effecting the product transfer includes an inclined skirt or lip 32 depending from one side of each slot (see FIG. 8) defining a product lifting means which operates to "shave" the product advanced by the elevator, as the transfer means rotates relative to the housing means.

Figure 7:
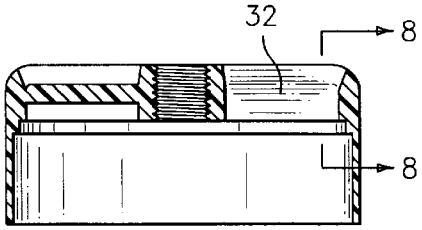
FIG. 7 is a vertical section of the transfer means of FIG. 6 taken along the broken line 7—7.

It is to be understood that product flows out of each slot uniformly and the small arrows of FIGS. 1 and 7 are inserted merely to indicate direction of product flow by the lifting action of each skirt 32.

The angle $\alpha$ of inclination of each skirt 32 relative to the vertical line L may range from 10 degrees to 50 degrees as viscosity and application rate dictate.

The product can be loaded into the housing means in a number of ways, i.e. from top or bottom as desired.

While the loading method is not critical to the operation of dispenser package it appears advisable to disclose and describe one method of loading product P.

Assume that the empty transfer means with fixedly attached lead screw is assembled to the empty housing in the fashion of FIG. 1.

Assume further that the bottom of the housing means is open, i.e. closure 34 is removed and the elevator 19 is also removed so that the lead screw 26 projects downwardly and centrally within the open empty housing means;

With the unit in the condition just described the unit is inverted so that the open housing means faces upwardly and the transfer means is facing downwardly.

In this condition product is loaded into the open end around the lead screw. Thereafter the elevator is threaded upon the lead screw and is advanced axially to engage product. Next the closure 34 is fitted to the housing means to close the unit.

Thereafter upon inverting the dispenser package so that the transfer means is uppermost the unit is ready for operation by rotation of the transfer means relative to the housing means whereupon the elevator moves axially toward the transfer means to supply product for transfer from the interior of the housing means to the applicator surface as previously described.

Figure 9:
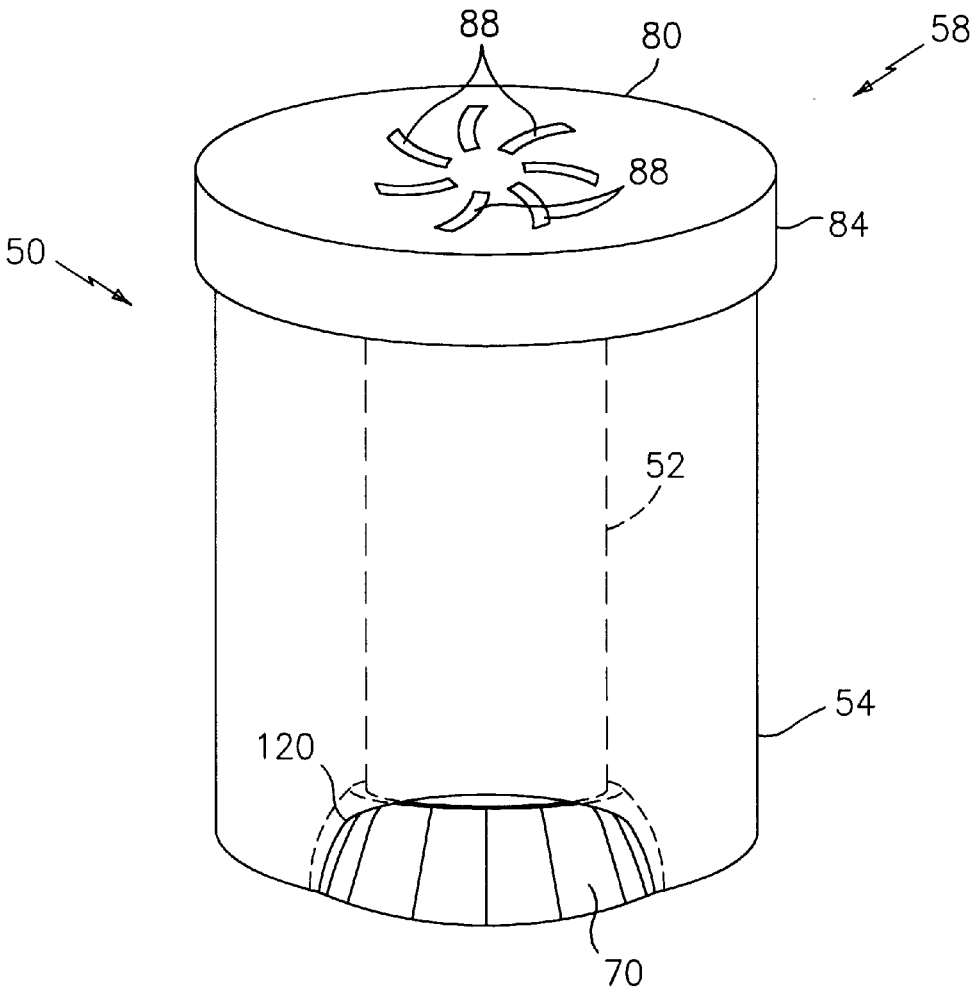
FIG. 9 is a perspective view of an alternative embodiment of the present invention.
Figure 12:
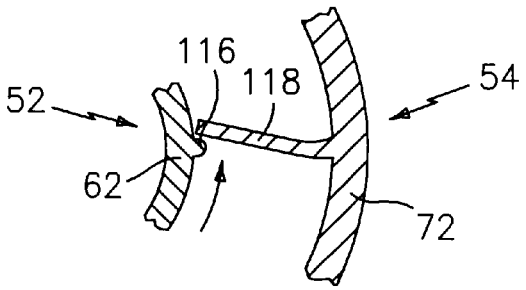
FIG. 12 is a cross-sectional view taken along the lines B—B of FIG. 10.
Figure 10:
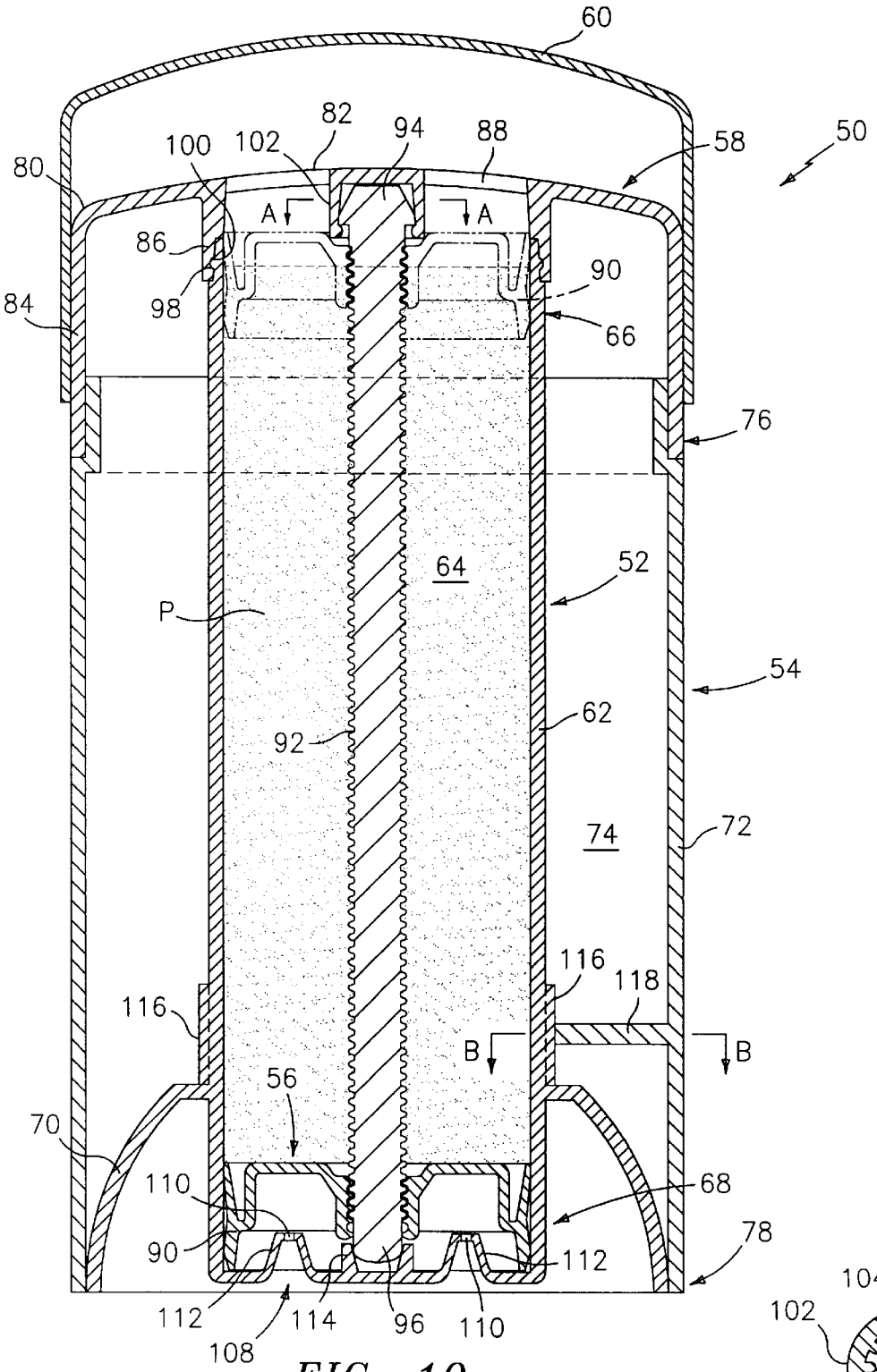
FIG. 10 is a cross-sectional view of the embodiment of FIG. 9.

Referring now to FIG. 9, an alternative embodiment of the present invention is illustrated. In this embodiment, a structure very similar to that illustrated in FIG. 1 is incorporated into an additional housing member so that rotation of an inner housing relative to an outer housing produces product on an applicator surface for use as desired. Referring collectively to FIGS. 9 and 10, a dispenser 50 is illustrated having an inner housing member 52, an outer housing member 54, an elevator assembly 56 positioned within inner housing 52 and a transfer assembly 58 associated with inner housing 52 and outer housing 54 for transferring product P from within inner housing 52 to exterior of inner housing 52. Dispenser 50 may also suitably include a closure or cap 60 as shown.

In accordance with this embodiment of the present invention, inner housing 52 is preferably a substantially circular-shaped cylinder having a wall 62 defining an inner space 64 for containing product P, and having an upper end 66 and a lower end 68. As shown, inner housing 52 may suitably have a flared skirt member 70 positioned so as to extend from outer housing 54 for use in operating dispenser 50 as will be described further below.

Outer housing 54 is preferably provided as a wall member 72 configured to define an inner housing space 74 sufficient for rotatably receiving inner housing 52. Outer housing 54 also includes an upper end 76 and a lower end 78. Housing 54 may suitably have any desirable shape and may for example be provided having a substantially oval-shaped cross-section as illustrated. Of course, other shapes for outer housing 54 could be used.

Transfer assembly 58 is preferably provided as a closure member 80 for closing the upper end 76 of outer housing 54 and also the upper end 66 of inner housing 52. As shown, closure member 80 may suitably include an applicator surface 82 from which product P can be applied to the desired area, for example an underarm in the case of a deodorant product. Applicator surface 82 is preferably a substantially smooth curved surface as shown in FIG. 10. Closure member 80 also preferably includes an outer depending skirt member 84 for engaging outer housing 54 in a substantially fixed and non-rotatable manner. Closure member 80 preferably also includes an inner skirt member 86 for rotatably receiving upper end 66 of inner housing 52. Applicator surface 82 is preferably also provided with a series of slots or openings 88 having similar configuration to slots 31 along with angled or transfer surfaces 32 as described and illustrated in connection with FIGS. 1, 2, 6 and 8. In the embodiment of FIG. 9, slots 88 have a substantially arcuate shape. Of course, other shapes could be used. As set forth in connection with the embodiment of FIGS. 1–8, slots and depending transfer walls or structures advantageously serve to transfer product advanced to transfer assembly 58 from the inner space 66 of inner housing 52 to applicator surface 82 without subjecting product P to pressure which, as set forth above, can adversely affect the quality of product P.

Figure 8:
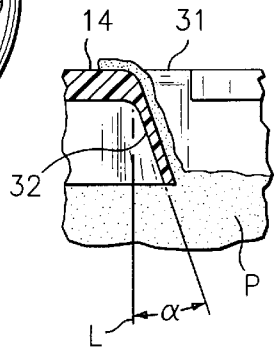
FIG. 8 is a vertical section of a portion of FIG. 7 in the plane of the line 8—8 showing transfer of product from the interior of the housing means to the applicator surface of the transfer means.

Elevator assembly 56 operates in a similar fashion to the elevator assembly described in connection with FIGS. 1–8. In the embodiment of FIGS. 9–12, elevator assembly 56 preferably includes an elevator member 90 slidably disposed within inner housing 52 and preferably substantially sealingly engaging with inner housing 52. Elevator assembly 56 preferably also includes a threaded member 92 which is threadedly engaged with elevator member 90 as shown, and which threaded member 92 also has a first end 94 which is preferably fixedly engaged with transfer assembly 58 as shown, and a second end 96 which is preferably rotatably received within inner housing 52. This advantageously allows for rotation of inner housing 52 relative to outer housing 54 which results in rotation of inner housing 52, elevator member 90 and product P relative to threaded member 92, thereby advancing elevator member 90 along threaded member 92. Rotation in one direction, in this embodiment, will therefore result in advancing of elevator member 90 toward upper end 66 of inner housing 52 and transfer assembly 58 as desired. This advancing motion is also accompanied by rotation of inner housing 52 and product P relative to the structure of slots 88 of transfer assembly 58, thereby advantageously resulting in transfer of product P out of slots 88 substantially as described in connection with the embodiments of FIGS. 1–8, particularly as illustrated in FIG. 8.

Outer housing 54 and transfer assembly 58 are preferably provided with structure for rotatably engaging inner housing 52 so as to provide stable operation of dispenser 50. In the embodiment illustrated in FIGS. 9 and 10, transfer assembly 58 includes downward depending skirt structure 86 which itself contributes to stability of inner housing 52. In addition, skirt 86 could be provided with a notch 98 and upper end 66 of inner housing 52 could suitably be provided with a radially outwardly extending protrusion 100 for extending into notch 98 to provide for snapping inner housing 52 into transfer assembly 58 in a rotatable and stable manner. Outer housing 54 could suitably be provided with similar structure to notch 98 and protrusion 100, if desired.

Figure 11:
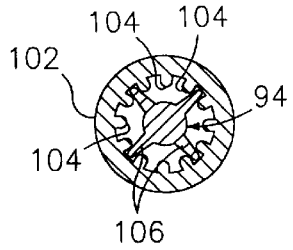
FIG. 11 is a cross-sectional view taken along the lines A—A of FIG. 10.

As set forth above, it is preferred that threaded member 92 have first end 94 substantially fixedly engaged relative to transfer assembly 58. Referring now to FIG. 11, one structure for accomplishing this engagement is illustrated. As shown, transfer assembly 58 may include a further skirt member 102 having inwardly extending teeth 104, and first end 94 of threaded member 92 may have outwardly extending teeth 106 adapted for non-rotatable engagement with teeth 104 of skirt 102. This advantageously allows for ease of assembly of threaded member 92 into transfer assembly 58 with threaded member 92 fixed against rotation relative to transfer assembly 58 as desired.

In accordance with a further embodiment of the present invention, inner housing 52 preferably has a substantially closed bottom 108 as shown in FIG. 10. This advantageously serves to catch any product P which could inadvertently slip past elevator member 90 in inner space 64 of inner housing 52. Closed bottom 108 thereby advantageously avoids the possibility of product P leaking out of dispenser 50 from other than applicator surface 82. In further accordance with this embodiment of the present invention, closed bottom 108 may suitably be provided with one or more vents 110 which may suitably have the form of a simple opening, or cone-shaped opening 112 as shown in FIG. 10, which advantageously serve to prevent a vacuum from forming between elevator member 92 and lower end 68 of inner housing 52 when elevator member 90 is upwardly advanced within inner housing 52.

Closed bottom 108 also preferably includes an upwardly extending structure 114 which may suitably be an upwardly extending circular structure for rotatably receiving second end 96 of threaded member 92 as desired.

In further accordance with this embodiment of the present invention, it is desired that dispenser 50 be provided with structure for providing a sensible or audible condition or signal corresponding to rotation of inner housing 52 relative to outer housing 54. This is desirable so as to provide a user of dispenser 50 with an indication as to how much product has been advanced during use of dispenser 50. Referring to FIG. 10 and also to FIG. 12, a structure in accordance with the present invention for providing such a signal is illustrated. As shown, inner housing 52 may suitably be provided with a tab or outwardly extending member 116, and outer housing 54 may suitably be provided with a tab or inwardly extending member 118, and tabs 116, 118 are configured so as to extend radially past each other. In this manner, tab 118 extends inwardly into a path of rotation of tab 116 such that tab 118 snaps or clicks past tab 116 as inner housing 52 is rotated relative to outer housing 54. In this embodiment, tab 118 is preferably a sufficiently flexible material that an audible click is generated when tab 116 passes by and disengages from tab 118, without causing significant resistance to rotation.

In this configuration, inner housing 52 is preferably provided with a plurality of tabs 116 substantially equally spaced around a perimeter thereof, and outer housing 54 is preferably provided with a single flexible tab 118 extending inwardly for clicking engagement with tabs 116 as they are rotated passed tab 118. It should be appreciated, of course, that tabs 116, 118 could be provided in different configurations, for example with flexible tabs on inner housing 52, or with a plurality of tabs extending inwardly from outer housing 54 and just a single tab extending outwardly from inner housing 52, if desired, all well within the scope of the present invention.

Returning to FIG. 9, outer housing 54 is preferably provided with a cutout 120 preferably positioned so as to allow easy access to flared skirt 70 of inner housing 52. This advantageously allows for easy operation of dispenser 50.

It should readily be appreciated that a dispenser 50 has been provided as illustrated in FIGS. 9–12 which is convenient in use, easy to manufacture, and satisfies the objectives of the present invention in providing a dispenser whereby product is advanced for transfer to an applicator surface without subjecting the product to increased pressure which can cause breakdown of the product.

In addition, dispenser 50 in accordance with the present invention advantageously provides for operation without generating internal vacuum within the inner housing assembly, which could render continued use of dispenser 50 difficult. Further, dispenser 50 advantageously provides an audible signal for indicating to a user how much product has been dispensed.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A dispenser assembly, comprising:

an inner housing having an upper end, a lower end, and a wall defining a product space for containing a product to be dispensed;

an outer housing having an upper end, a lower end, and a wall defining an inner space, said lower end of said outer housing at least partially surrounding said lower end of said inner housing, said inner housing being rotatably mounted within said outer housing so that said inner housing can be rotated relative to said outer housing;

means within said inner housing for advancing product toward said upper end of said inner housing responsive to rotation of said inner housing relative to said outer housing; and a transfer member fixed relative to said outer housing and rotatably associated with said upper end of said inner housing, said transfer member having an applicator surface for applying product to a desired area, and at least one slot in said applicator surface for allowing transfer of product from said product space through said transfer member to said applicator surface.

2. A dispenser assembly according to claim 1, wherein said transfer member further includes an outer skirt structure for fixedly engaging said upper end of said outer housing, and an inner skirt structure for rotatably receiving said upper end of said inner housing.

3. A dispenser assembly according to claim 1, wherein said means for advancing product comprises an elevator positioned within said inner housing non-rotatable relative to said inner housing, and a threaded member threadably engaged with said elevator, and having a first end non-rotatably engaged with said transfer member and a second end rotatably positioned relative to said inner housing whereby rotation of said inner housing relative to said outer housing rotates said elevator relative to said threaded rod so as to advance said elevator toward said transfer member.

4. A dispenser assembly according to claim 3, wherein said at least one slot includes an angled surface extending toward said product space whereby rotation of said elevator relative to said transfer member causes product to move along said angled surface to said applicator surface.

5. A dispenser according to claim 1, further comprising structure associated with said inner housing and said outer housing for making a sensible condition upon rotation of said inner housing relative to said outer housing.

6. A dispenser assembly according to claim 5, wherein said structure comprises at least one inner tab positioned on an outer surface of said inner housing, and at least one outer tab extending from said outer housing into a path of rotation of said inner tab whereby rotation of said inner housing relative to said outer housing causes said inner tab and said outer tab to engage each other and generate said sensible condition.

7. A dispenser according to claim 6, wherein at least one of said inner tab and said outer tab is resilient whereby said sensible condition is a clicking sound.

8. A dispenser according to claim 1, wherein said inner housing has a closed bottom for preventing leakage of product past said elevator to exterior of said housing.

9. A dispenser according to claim 8, wherein said closed bottom further includes a vent whereby said elevator can move upwardly relative to said inner housing without creating a vacuum between said elevator and said lower end.

10. A dispenser according to claim 1, wherein said transfer member and said means for advancing product are adapted to transfer product to said applicator surface at least as quickly as product is delivered to said transfer member.

* * * * *